US007278348B2

(12) United States Patent
Kleinbeck et al.

(10) Patent No.: US 7,278,348 B2
(45) Date of Patent: Oct. 9, 2007

(54) HIGH-PRESSURE PUMP FOR A FUEL INJECTION SYSTEM OF AN INTERNAL COMBUSTION ENGINE

(75) Inventors: Thomas Kleinbeck, Vaihingen/Enz-Riet (DE); Andreas Vogt, Renningen (DE); Alexander Redlich, Leinfelden-Echterdingen (DE); Markus Koch, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 255 days.

(21) Appl. No.: 10/537,247

(22) PCT Filed: Aug. 11, 2003

(86) PCT No.: PCT/DE03/02703

§ 371 (c)(1),
(2), (4) Date: Jun. 1, 2005

(87) PCT Pub. No.: WO2004/051084

PCT Pub. Date: Jun. 17, 2004

(65) Prior Publication Data

US 2006/0093490 A1 May 4, 2006

(30) Foreign Application Priority Data

Dec. 4, 2002 (DE) ..... 102 56 528

(51) Int. Cl.
*F04B 1/053* (2006.01)
*F02M 59/06* (2006.01)

(52) U.S. Cl. ..... 92/155; 92/72

(58) Field of Classification Search ..... 92/72, 92/129, 155, 158, 159; 91/491; 417/273
See application file for complete search history.

(56) References Cited

U.S. PATENT DOCUMENTS

| | | | | |
|---|---|---|---|---|
| 3,628,425 | A * | 12/1971 | Morita et al. | 92/72 |
| 4,222,714 | A * | 9/1980 | Dantlgraber | 417/273 |
| 4,799,654 | A * | 1/1989 | Eickmann | 92/45 |
| 4,975,025 | A * | 12/1990 | Yamamura et al. | 417/273 |
| 5,937,734 | A * | 8/1999 | Stiefel et al. | 92/129 |
| 5,979,297 | A * | 11/1999 | Ricco | 92/129 |
| 6,123,009 | A | 9/2000 | Kanayama et al. | |
| 6,183,212 | B1 * | 2/2001 | Djordjevic | 417/273 |
| 7,086,324 | B2 * | 8/2006 | Buettner et al. | 92/129 |

FOREIGN PATENT DOCUMENTS

| | | | |
|---|---|---|---|
| DE | 19836901 | A1 * | 2/2000 |
| EP | 0 851 120 | A2 | 7/1998 |
| EP | 0 890 743 | A2 | 1/1999 |
| JP | 2002227761 | A * | 8/2002 |
| WO | WO 00/49291 | A2 | 8/2000 |

* cited by examiner

*Primary Examiner*—Thomas E. Lazo
(74) *Attorney, Agent, or Firm*—Ronald E. Greigg

(57) ABSTRACT

A high-pressure pump having a drive shaft and at least one pump element including a pump piston driven in a reciprocating motion by the drive shaft. A ring on which the pump piston is braced via a support element is rotatably supported on a portion of the drive shaft that is disposed eccentrically to its pivot axis. The ring and/or the support element, at least in their contact region, has many microscopic indentations, and a solid lubricant film is applied to the ring and/or to the support element, at least in their contact region.

21 Claims, 3 Drawing Sheets

HIGH-PRESSURE PUMP FOR A FUEL INJECTION SYSTEM OF AN INTERNAL COMBUSTION ENGINE

CROSS-REFERENCE TO RELATED APPLICATIONS

This application is a 35 USC 371 application of PCT/DE 03/02703 filed on Aug. 11, 2003.

BACKGROUND OF THE INVENTION

1. Field of the Invention

The invention is directed to an improved high-pressure pump for a fuel injection system of an internal combustion engine.

2. Description of the Prior Art

One high-pressure pump known from German Patent Disclosure DE 198 29 548 A1 has a drive shaft and at least one pump element with a pump piston driven in a reciprocating motion by the drive shaft having a shaft segment embodied eccentrically to its pivot axis, and a ring is rotatably supported on this portion. The pump piston is braced on the ring via a support element. The rotary motion of the drive shaft is converted into a reciprocating motion of the pump piston via the ring, which does not rotate jointly with the drive shaft. In the contact region between the ring and the support element, high forces occur because of the pressure generated by the pump piston. To further reduce fuel consumption and emissions in internal combustion engines, increasingly high pressures in fuel injection are needed and must be generated by the high-pressure pump. As a result, the load on the components of the high-pressure pump and the wear to the ring and the support element both increase. Moreover, for reducing emissions, new fuels are being developed that in particular contain little sulfur, but the lubricating properties of the fuel are worsened as a result. For this reason, under some circumstances it is no longer possible to assure that the high-pressure pump will have a sufficiently long service life.

SUMMARY AND ADVANTAGES OF THE INVENTION

The high-pressure pump of the invention has the advantage over the prior art that the wear resistance of the ring and the support element is improved to such an extent that the high-pressure pump attains a sufficiently long service life even when very high pressures are generated and when the fuel has only little lubricating action.

BRIEF DESCRIPTION OF THE DRAWINGS

One exemplary embodiment of the invention is described in further detail herein below, with reference to the drawings, in which.

DESCRIPTION OF THE PREFERRED EMBODIMENT

Figure 1:
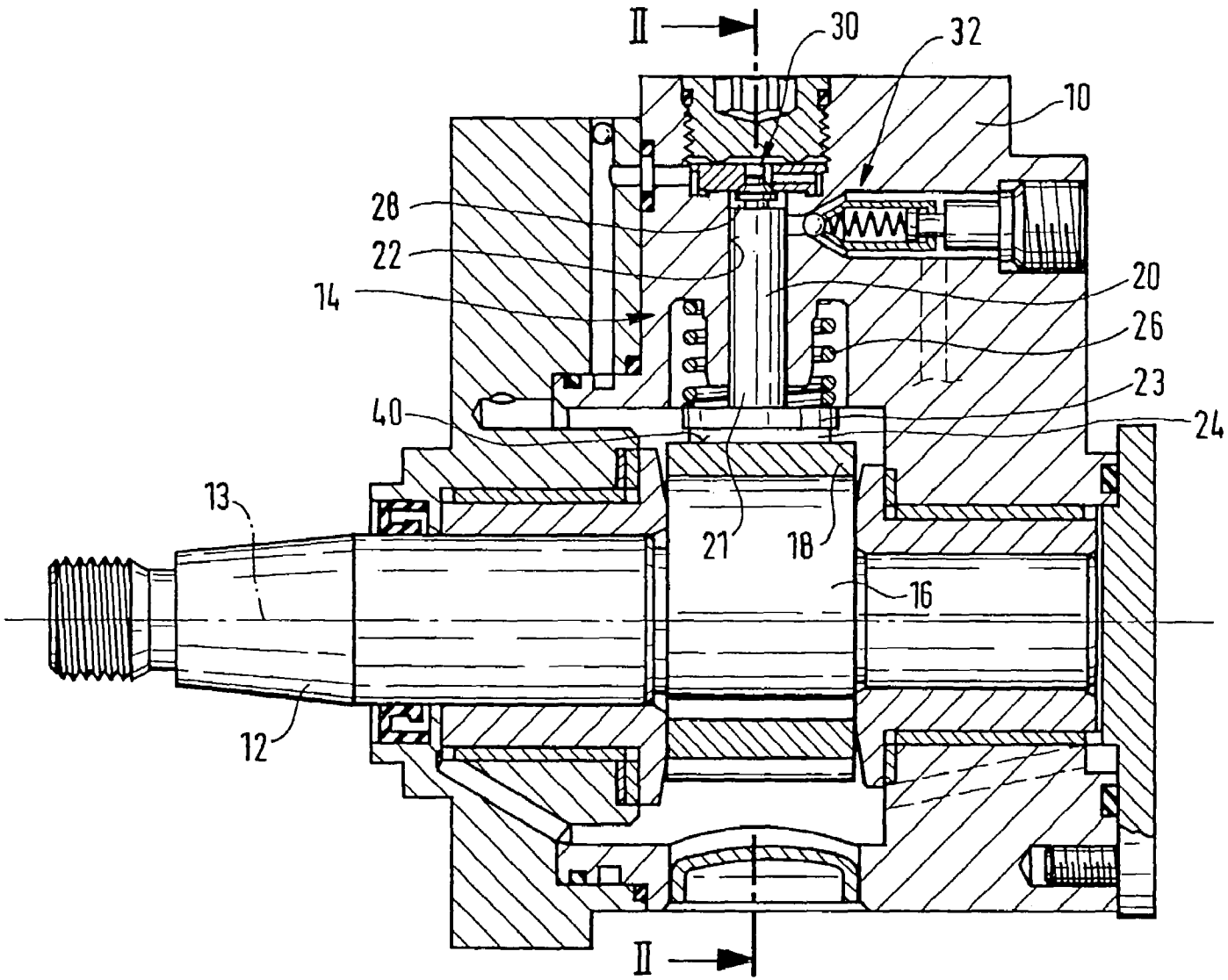
FIG. 1 shows a high-pressure pump in a longitudinal section.
Figure 2:
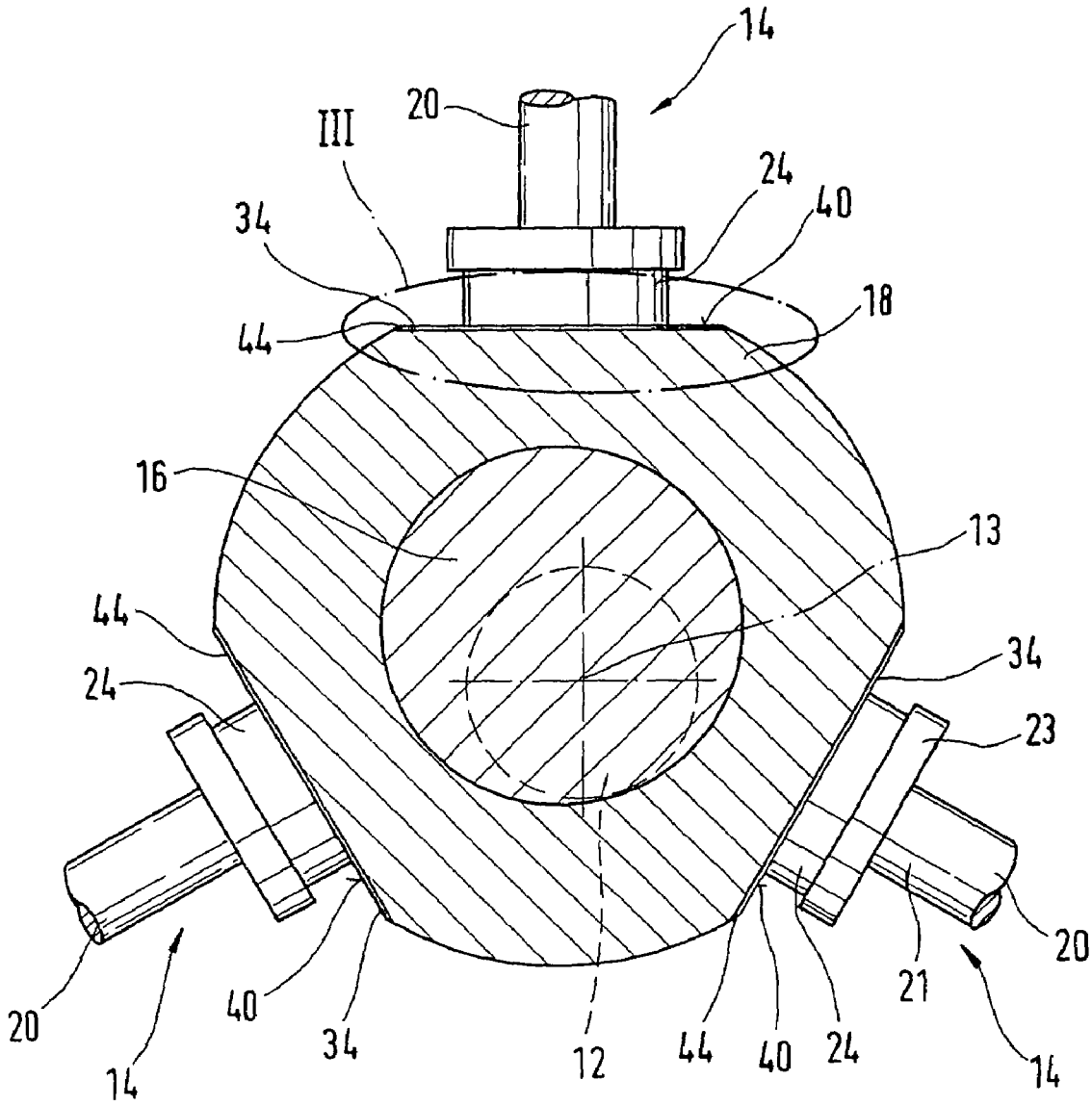
FIG. 2 shows the high-pressure pump in a cross section taken along the line II-II in FIG. 1.

In FIGS. 1 through 6, a high-pressure pump for a fuel injection system of an internal combustion engine, for instance of a motor vehicle, is shown that is embodied as a radial piston pump. By means of the high-pressure pump, fuel is pumped at high pressure, of up to 2000 bar, for instance into a reservoir from which fuel is drawn for injection into the engine. The high-pressure pump has a housing 10, in which a drive shaft 12 is rotatably supported about an axis 13. In the housing 10, at least one and preferably more pump elements 14 are disposed, which are driven by the drive shaft 12. The drive shaft 12 has a shaft portion 16, embodied eccentrically to its rotation axis 13, on which a ring 18 is rotatably supported. Each of the pump elements 14 has a pump piston 20, which is guided tightly and displaceably in a cylinder bore 22 that extends at least approximately radially to the pivot axis 13 of the drive shaft 12. The pump piston 20 of each pump element 14 is braced with its piston base 21 on the ring 18 via a support element 24. The piston base 21 may be kept in contact with the support element 24 and via it with the ring 18 by means of a spring 26, which is braced on one end on the housing 10 and on the other on the support element 24 via a spring plate 23. The support element 24 may be embodied for instance as a support plate or as a tappet.

The various pump pistons 20 each define a pump work chamber 28, which by means of an inlet valve 30 opening into the pump work chamber 28 can be made to communicate with a fuel supply in which low pressure prevails. The pump work chamber 28 can also be made to communicate with the reservoir, by means of an outlet valves 32 that opens toward the reservoir. Upon the rotation of the drive shaft 12, the pump piston 20 is driven in a reciprocating motion via the eccentric shaft portion 16 of the drive shaft 12 and via the ring 18, which does not rotate jointly with the drive shaft 12. When the pump piston 20 moves radially inward, it executes an intake stroke, in which the inlet valve 30 is opened, so that fuel flows into the pump work chamber 28, while the outlet valve 32 is closed. When the pump piston 20 moves radially outward, it executes a supply stroke, in which the inlet valve 30 is closed, and the fuel compressed by the pump piston 20 passes at high pressure through the opened outlet valve 32 to reach the reservoir.

The ring 18 has a number of flattened faces 34 on its outside, which correspond in number to the number of pump elements 14 and on which faces the respective support element 24 rests. During the operation of the high-pressure pump, the ring 18 and the support elements 24 are loaded by oscillation in their supply stroke and intake stroke because of the cyclical loading and relief of the pump pistons 20, causing variously high pressure forces to act in the contact region between the support elements 24 and the ring 18. Preferably, it is provided that the quantity of fuel pumped by the high-pressure pump can be adapted to the demand of the engine. To that end, the inflow of fuel into the pump work chambers 28 can be limited in such a way that these chambers are only partly filled. This can be done for instance by means of intake throttling in the inlet to the pump work chambers 28. Upon partial filling of the pump work chambers 28, additionally impacting loads occur on the ring 18 and the support elements 24, since the fuel pumping and hence the pressure relief of the ring 18 and the support elements 24 do not occur until after a partial idle stroke of the pump pistons 20.

On the outside of the ring 18, at least on the flat faces 34 that represent the contact region with the support elements 24, a solid lubricant film 40 is applied. Also on its outside, at least on the flat faces 34 and thus in the contact region with the support elements 24, the ring 18 also has many microscopic indentations 42, which are shown enlarged in FIGS. 3 through 6. The ring 18 is preferably of steel.

Figure 3:
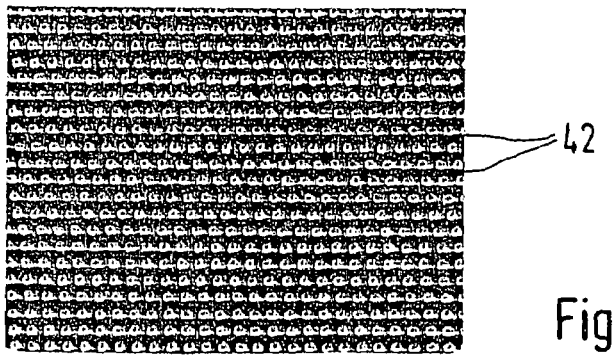
FIG. 3 shows a detail, marked III in FIG. 2, of the high-pressure pump with a first version of microscopic indentations.
Figure 4:
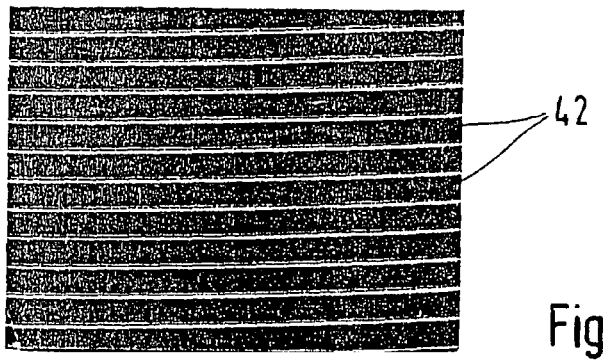
FIGS. 4 through 6 show further versions of microscopic indentations.
Figure 5:
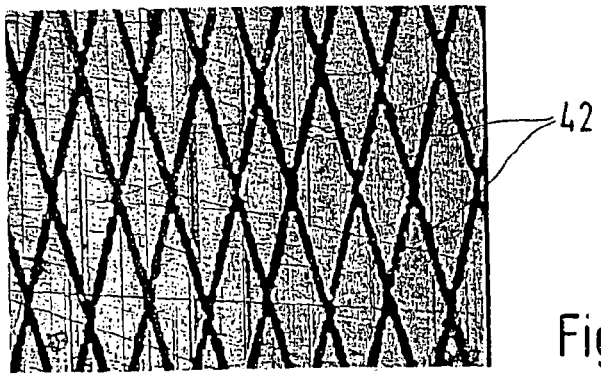
Figure 6:
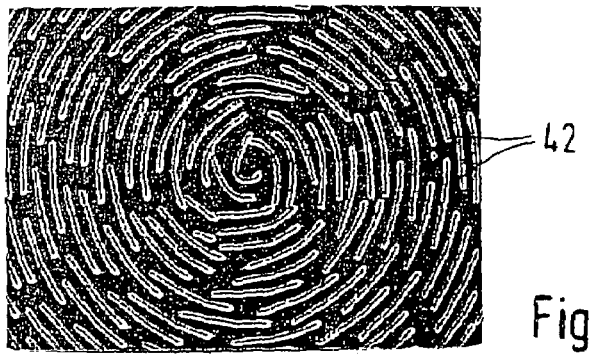

The microscopic indentations 42 may for instance, as shown in FIG. 3, be embodied as dimples, which are distributed uniformly or irregularly over the surface of the flattened faces 34 of the ring 18. Alternatively, as shown in FIG. 4, the microscopic indentations 42 may also be embodied as at least approximately straight grooves that extend longitudinally or transversely or with an arbitrary other orientation over the surface of the flattened faces 34 of the ring 18. Alternatively, as shown in FIG. 5, the microscopic indentations 42 may also be embodied as intersecting grooves, which extend over the surface of the flattened faces 34 of the ring 18. Also alternatively, as shown in FIG. 6, the microscopic indentations 42 may be embodied as grooves extending at least approximately in the form of segments of a circle, which are distributed over the surface of the flattened faces 34 of the ring 18, extending at least approximately concentrically to one another. A combination of the above-described various embodiments of the microscopic indentations 42 may also be used.

The microscopic indentations 42 preferably have a depth of approximately 2 to 30 μm, a width of approximately 15 to 30 μm, and a spacing from one another of approximately 30 to 150 μm. The microscopic indentations 42 may be made into the surface of the flattened faces 34 of the ring 18 by means of known machining methods, such as laser production, hard turning, spark erosion, or lithographic methods.

The solid lubricant film 40 is applied to the surface of the flattened faces 34 of the ring 18 and may cover the entire surface, that is, not only the microscopic indentations 42 but also the raised regions located between them. The microscopic indentations 42 may accordingly be duplicated as indentations in the surface of the solid lubricant film 40. Fuel can accumulate in the indentations in the solid lubricant film 40, as a result of which fuel the lubrication between the ring 18 and the support elements 24 is improved. At the onset of operation of the high-pressure pump, the solid lubricant film 40 is present between the contact regions of the ring 18 and the support elements 24 and facilitates the startup of the high-pressure pump; however, the solid lubricant film 40 is worn away during operation of the high-pressure pump. After a certain length of operation of the high-pressure pump, the solid lubricant film 40 will be present only in the microscopic indentations 42 any longer. If further wear of the ring 18 occurs, more and more lubricant constantly escapes from the microscopic indentations 42 and improves the lubrication between the ring 18 and the support elements 24. The thickness of the solid lubricant film 40 in its outset state is for instance between 10 μm and 20 μm.

It may also be provided that the solid lubricant film 40 is applied to the ring 18 first, and the microscopic indentations 42 are made after that. In that case, there is no lubricant located in the microscopic indentations 42, but the microscopic indentations have the effect that fuel accumulates in them and improves the lubrication between the ring 18 and the support elements 24.

Alternatively, it may be provided that the solid lubricant film 40 is introduced only into the microscopic indentations 42, while the raised regions between them have no solid lubricant film 40. During operation of the high-pressure pump, lubricant then constantly emerges from the microscopic indentations 42 because of the incident wear and improves the lubrication between the ring 18 and the support elements 24. It may also be provided that the solid lubricant film 40 fills up only part of the depth of the microscopic indentations 42. In this case, fuel can accumulate in the microscopic indentations 42 at the onset of operation of the high-pressure pump, and by this fuel the lubrication between the ring 18 and the support elements 24 is improved. With increasing time in operation of the high-pressure pump, wear reduces the depth of the microscopic indentations 42, so that the lubricant gradually emerges from them and then improves the lubrication between the ring 18 and the support elements 24.

The solid lubricant film 40 comprises a binder material in which solid lubricant particles are embedded. The solid lubricant film 40 may be applied to the ring 18 in the form of a liquid paint, for instance, or by other known application techniques. The binder material may comprise organic or inorganic compounds. The use of inorganic compounds for the binder material offers the advantage over organic compounds of greater temperature resistance. The use of organic compounds for the binder material offers the advantage over inorganic compounds of better corrosion resistance. The choice of the binder material will be oriented to the requirements in terms of temperature resistance and fuel resistance. The solid lubricant particles are uniformly located in the binder material in the form of particles of a size that is a few micrometers, preferably between about 3 and 8 μm, in diameter. As lubricants, polytetrafluoroethylene or graphite or molybdenum disulfide may be used in particular, and a mixture of these substances may also be employed. A mixture of polytetrafluoroethylene and molybdenum disulfide makes a low coefficient of friction possible between the ring 18 and the support elements 24.

To optimize the adhesion of the solid lubricant film 40 to the ring 18, a chemical pretreatment of the surface of the ring 18 may be performed, such as phosphating, by which an adhesion-promoting intermediate layer 44 is created. This intermediate layer should be applied in such a way that it does not level off the microscopic indentations 42. At maximum, the thickness of the intermediate layer should be approximately 20% of the depth of the microscopic indentations 42.

Alternatively or in addition to the ring 18, the support elements 24 may also be provided, in its contact region with the ring 18, with a corresponding solid lubricant film 40 and microscopic indentations 42 as described above.

The foregoing relates to a preferred exemplary embodiment of the invention, it being understood that other variants and embodiments thereof are possible within the spirit and scope of the invention, the latter being defined by the appended claims.

The invention claimed is:

1. A high-pressure pump for a fuel injection system of an internal combustion engine, comprising a drive shaft (12), at least one pump element (14), which has a pump piston (20) driven in a reciprocating motion by the drive shaft (12), a ring (18) rotatably supported on a portion (16) of the drive shaft (12) disposed eccentrically to the pivot axis (13) of the drive shaft, on which ring the pump piston (20) is braced via a support element (24), many microscope indentations (42) formed in the ring (18) and/or the support element (24), at least in their contact region; and a solid lubricant film (40) is applied to at least one of the ring (18) and the support element (24) in the region of the microscopic indentations.

2. The high-pressure pump of claim 1, wherein the microscopic indentations (42) have a depth of approximately 2 to 30 μm and/or a width of approximately 15 to 30 μm and/or a spacing from one another of approximately 30 to 150 μm.

3. The high-pressure pump of claim 2, wherein the microscopic indentations (42) are embodied in the form of dimples.

4. The high-pressure pump of claim 2, wherein the microscopic indentations (42) are embodied in the form of grooves.

5. The high-pressure pump of claim 4, wherein the grooves intersect.

6. The high-pressure pump of claim 4, wherein the grooves are embodied at least approximately in the shape of segments of a circle.

7. The high-pressure pump of claim 2, wherein the solid lubricant film (40) contains polytetrafluoroethylene and/or graphite and/or molybdenum disulfide.

8. The high-pressure pump of claim 2, wherein the solid lubricant film (40) has a binder material, in which solid lubricant particles are embedded, distributed uniformly.

9. The high-pressure pump of claim 2, wherein an adhesion-promoting intermediate layer (44) is disposed between the surface of the ring (18) and/or of the support element (24) and the solid lubricant film (40).

10. The high-pressure pump of claim 1, wherein the microscopic indentations (42) are embodied in the form of grooves.

11. The high-pressure pump of claim 10, wherein the solid lubricant film (40) contains polytetrafluoroethylene and/or graphite and/or molybdenum disulfide.

12. The high-pressure pump of claim 10, wherein the solid lubricant film (40) has a binder material, in which solid lubricant particles are embedded, distributed uniformly.

13. The high-pressure pump of claim 1, wherein the solid lubricant film (40) contains polytetrafluoroethylene and/or graphite and/or molybdenum disulfide.

14. The high-pressure pump of claim 1, wherein the solid lubricant film (40) has a binder material, in which solid lubricant particles are embedded, distributed uniformly.

15. The high-pressure pump of claim 1, wherein an adhesion-promoting intermediate layer (44) is disposed between the surface of the ring (18) and/or of the support element (24) and the solid lubricant film (40).

16. A high-pressure pump for a fuel injection system of an internal combustion engine, comprising a drive shaft (12).

at least one pump element (14), which has a pump piston (20) driven in a reciprocating motion by the drive shaft (12), a ring (18) rotatably supported on a portion (16) of the drive shaft (12) disposed eccentrically to the pivot axis (13) of the drive shaft, on which ring the pump piston (20) is braced via a support element (24), many microscope indentations (42) formed in the ring (18) and/or the support element (24), at least in their contact region; and a solid lubricant film (40) applied to the ring (18) and/or to the support element (24), at least in their contact region, wherein the microscopic indentations (42) are embodied in the form of dimples.

17. The high-pressure pump of claim 16, wherein the solid lubricant film (40) contains polytetrafluoroethylene and/or graphite and/or molybdenum disulfide.

18. The high-pressure pump of claim 16, wherein the solid lubricant film (40) has a binder material, in which solid lubricant particles are embedded, distributed uniformly.

19. The high-pressure pump of claim 16, wherein an adhesion-promoting intermediate layer (44) is disposed between the surface of the ring (18) and/or of the support element (24) and the solid lubricant film (40).

20. A high-pressure pump for a fuel injection system of an internal combustion engine, comprising a drive shaft (12), at least one pump element (14), which has a pump piston (20) driven in a reciprocating motion by the drive shaft (12), a ring (18) rotatably supported on a portion (16) of the drive shaft (12) disposed eccentrically to the pivot axis (13) of the drive shaft, on which ring the pump piston (20) is braced via a support element (24), many microscope indentations (42) embodied in the form of grooves formed in the ring (18) and/or the support element (24), at least in their contact region; and a solid lubricant film (40) applied to the ring (18) and/or to the support element (24), at least in their contact region, and wherein the grooves intersect.

21. The high-pressure pump of claim 20, wherein the grooves are embodied at least approximately in the shape of segments of a circle.

* * * * *